United States Patent [19]

Kudlacek

[11] Patent Number: 4,593,674

[45] Date of Patent: Jun. 10, 1986

[54] COMPOUND ARCHERY BOW

[76] Inventor: Donald S. Kudlacek, 4312 Oak St., Longview, Wash. 98632

[21] Appl. No.: 647,117

[22] Filed: Sep. 4, 1984

Related U.S. Application Data

[63] Continuation of Ser. No. 315,704, Oct. 28, 1981, abandoned, which is a continuation-in-part of Ser. No. 194,429, Oct. 6, 1980, abandoned.

[51] Int. Cl.[4] ..... F41B 5/00

[52] U.S. Cl. ..... 124/23 R; 124/86

[58] Field of Search ..... 124/23 R, 24 R, 88, 124/DIG. 1, 90

[56] References Cited

U.S. PATENT DOCUMENTS

| | | | |
|---|---|---|---|
| 3,841,295 | 10/1974 | Hunter | 124/24 R |
| 3,923,035 | 12/1975 | Trotter | 124/24 R |
| 3,967,609 | 7/1976 | Frydenlund | 124/90 X |
| 4,192,280 | 3/1980 | Richard | 124/23 R |

*Primary Examiner*—Richard J. Apley
*Assistant Examiner*—William R. Browne
*Attorney, Agent, or Firm*—Olson and Olson

[57] ABSTRACT

A compound archery bow of simplified construction includes a bowstring secured intermediate its ends to eccentrically pivoted cams mounted at the outer ends of the limbs secured to the opposite ends of a handle member. A control cable connects each cam pivot shaft, and therefore each limb, to a laterally projecting post on a lever mounted pivotally on the end of the handle member that secures the opposite limb. The end segments of the bowstring are trained around the cams and through the diametric center of each cam wherein the segments are secured. Each terminal end portion of the bowstring end segments is secured either to a winch located on the lever mounting the associated cam, or directly to said lever. The connection of the limbs to each other through the control cables and the bowstring end segments secured to the levers balance the flexure of the limbs relative to each other as well as the rotation of each cam as the bowstring is drawn back. Adjustment of the length of the bowstring terminal end portions effects adjustment of the tension and flexure of the limbs, pull weight of the bowstring and angular disposition of the cams.

4 Claims, 12 Drawing Figures

COMPOUND ARCHERY BOW

REFERENCE TO RELATED APPLICATION

This is a continuation of my earlier co-pending but now abandoned application Ser. No. 315,704 filed Oct. 28, 1981 as a continuation-in-part of my abandoned parent application Ser. No. 194,429 filed Oct. 6, 1980.

BACKGROUND OF THE INVENTION

This invention relates to archery bows, and more particularly to an archery bow characterized by requiring lesser pull weight at full draw than at an intermediate position of draw.

Archery bows of the class described, and commonly referred to as compound bows have been provided heretofore. Their principal advantage resides in the reduction of pull weight at full draw, whereby an archer may utilize a pull weight greater than this normal physical capabilities, simultaneously affording greater sighting control.

One of the most accurate compound bows provided heretofore is disclosed in U.S. Pat. No. 3,841,295 of which I am the owner. However, it involves a rather complex and correspondingly costly construction.

SUMMARY OF THE INVENTION

In its basic concept, the compound bow of this invention involves the adjustable connection of a control cable between each cam pivot shaft at the opposite end of the bow and a lever located on the end of the handle mounting the limb carrying the opposite cam, and the adjustable connection of the bowstring end segments to the lever associated with the same cam.

It is by virtue of the foregoing basic concept that the principal objective of this invention is achieved; namely, to simplify the construction and cost of the compound bow of my U.S. Pat. No. 3,841,295.

Another important object of this invention is the provision of a compound bow of the class described which affords a substantial degree of adjustability of the tensioning of a working stretch portion of a bowstring, the tensioning and balancing of the limbs, the adjustability of the position of the nocking point during draw, the angular disposition of the cam member relative to the bowstring, and adjustment of the characteristic pull weight of the bow.

A further objective of this invention is to provide a compound archery bow of the class described which, by virtue of its construction and arrangement, increases arrow speed approximately 15 feet per second over that which is attainable with the compound bow of U.S. Pat. No. 3,841,295.

The foregoing and other objects and advantages of this invention will appear from the following detailed description, taken in connection with the accompanying drawings of preferred embodiments.

DESCRIPTION OF THE PREFERRED EMBODIMENTS

Figure 2:
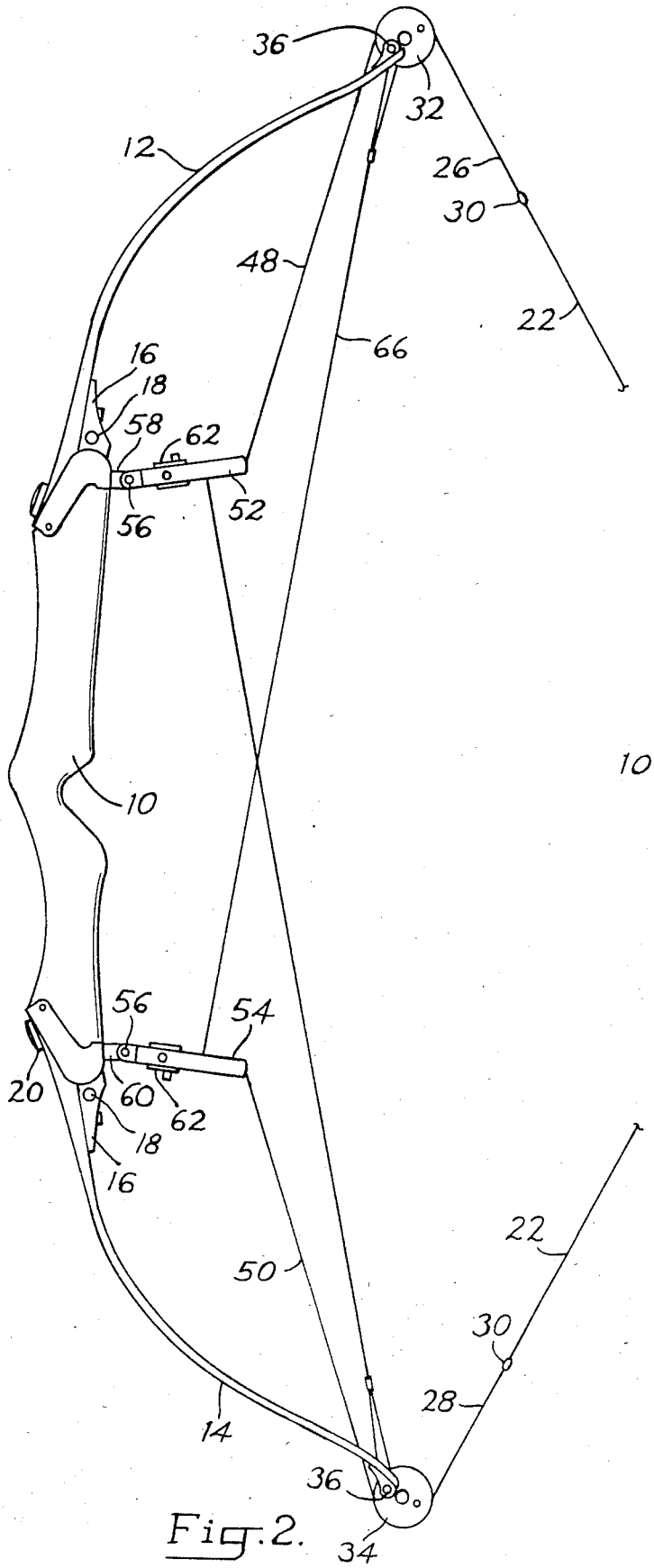
FIG. 2 is a fragmentary side elevation of the bow shown at full draw position.

The bow includes a central handle member 10, preferably made of light weight metal. A pair of resilient bow limbs 12 and 14 extend outwardly each from one end of the handle member. Although the limbs may be formed integral with the handle, the detachable and adjustable arrangement shown is preferred.

For this purpose, means for adjusting the limbs angularly relative to the handle member is provided by interengaging bearing means embodied herein as flanges 16 which receive cooperating pivot shafts 18. The flanges are mounted on the inner end portions of the limbs adjaceht the ends of the handle member 10. A pivot shaft 18 cooperating with each flange is provided through the handle member, pivotally connecting each limb to opposite ends of the handle. Limb adjusting screws 20 are threaded the terminal end portion of each limb and into the handle member. Rotating the limb screws 20 to move them inwardly or outwardly relative to the handle causes the corresponding limb to pivot about the bearing shaft. Accordingly, the angle of each limb relative to the handle may be adjusted independently.

Figure 3:
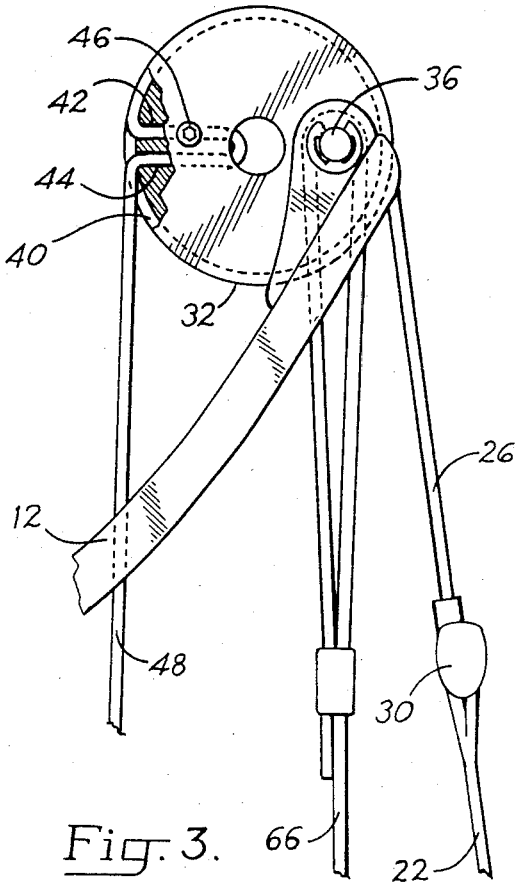
FIG. 3 is a fragmentary side elevation of the upper eccentric cam member at the upper end of the bow in FIG. 1.
Figure 4:
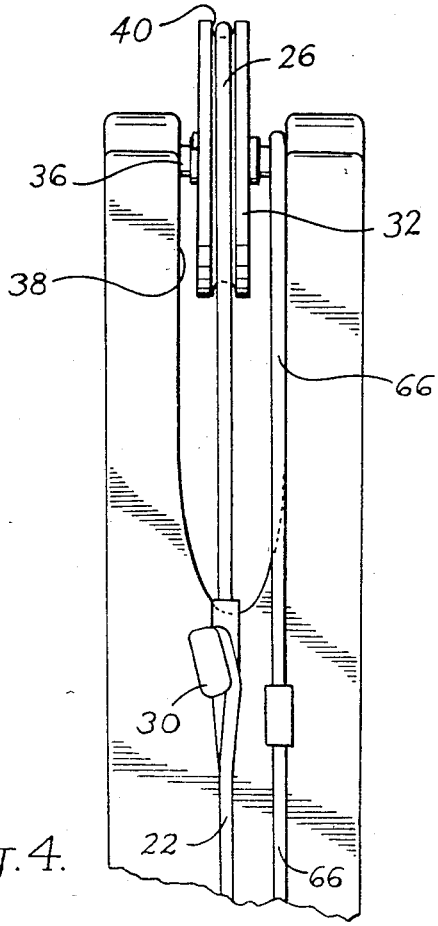
FIG. 4 is a fragmentary rear elevation of the upper eccentric cam member as viewed from the right in FIG. 3.

The bow includes a string by which an arrow is projected. In the embodiment illustrated, the bowstring includes an elongated, intermediate working stretch 22 provided with the usual nocking point 24, and a pair of opposite end segments 26 and 28 connected detachably to the opposite ends of the working stretch by a coupling member 30 as shown in FIGS. 3 and 4, and described in detail in my patent U.S. Pat. No. 3,841,295.

The end segments 26 and 28 of the bowstring are trained about a pair of cam members 32 and 34, respectively, mounted at the outer ends of the limbs 12 ahd 14, respectively, each by means of an eccentrically located pivot shaft 36. As best shown in FIG. 4, each cam member is received freely within a central slot 38 provided at the outer end of each limb.

In the preferred embodiment illustrated, and best shown in FIGS. 3 and 4, each cam member is in the form of a circular disc provided with a single circumferential guide groove 40 and a pair of spaced-apart radial bores 42 and 44. In FIG. 3, the end segment 26 of the bowstring extends from the coupling member 30 and is trained about the guide groove 40 in the upper cam 32 counterclockwise for approximately 180° and then extends inward through the radial bore 42 where it is secured by a set screw 46. The terminal end portion 48 of segment 26 extends from the set screw outward through radial bore 44. In similar manner, the end segment 28 is trained about the groove in the lower cam member 34 clockwise and extended through the radial bore 42 of the lower cam member and secured by a set screw 46, and the terminal end portion 50 extended therefrom outward through the bore 44 in the manner previously described for the upper cam.

The terminal end portions 48 and 50 of the end segments 26 and 28 extend from the set screws 46 through the radial bores and are trained back onto the guide grooves 40 of the cam members. Although shown as a continous line extending through the pairs of radial bores, the bowstring end segments and terminal end portions are effectively divided into two parts by being secured by set screw 46. Accordingly, it will be understood that securing the ends of two separate lines in the radial bores, as by separate set screws or other connectors, would accomplish the same result. Therefore, the portions 48 and 50 of the end segments 26 and 28 extending beyond the set screws 46 are identified herein as terminal end portions 48 and 50 of the end segments 26 and 28 of the bowstring, and may be provided as separate lines.

Figure 1:
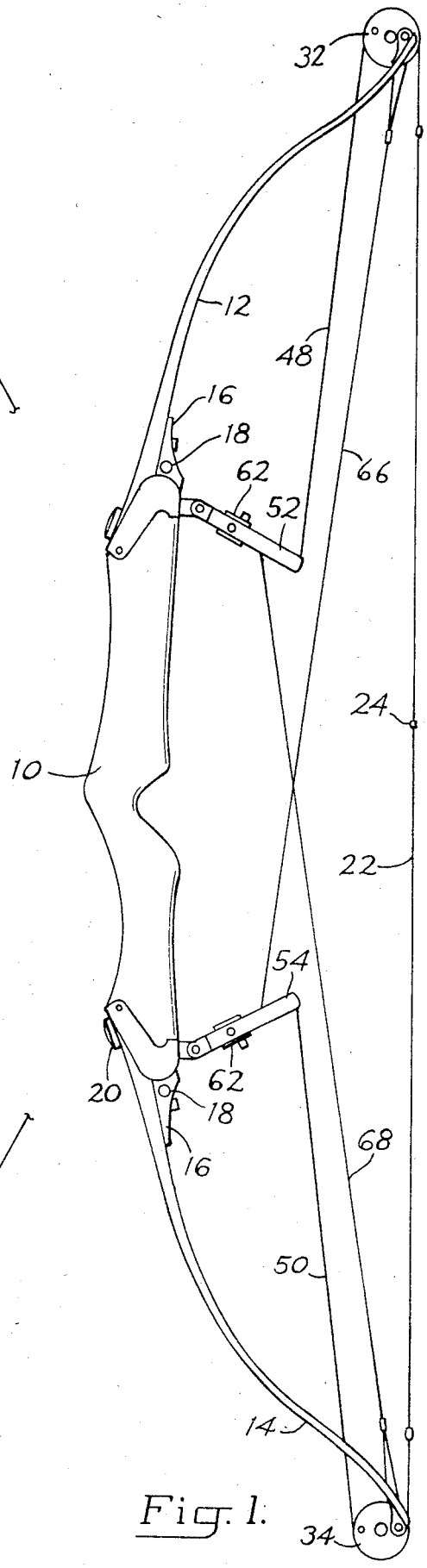
FIG. 1 is a side elevation of a compound archery bow embodying the features of this invention, the same being shown at rest position.

The lines 48 and 50 extend from the cams for connection to adjustable tensioning controls. In the embodiment of FIG. 1, and best illustrated in FIGS. 5 and 6, the tensioning control includes a pair of elongated levers 52 and 54 mounted at the opposite end portions of the handle member 10. One lever is associated with each of the opposite terminal end portions of the bowstring. The inner end of each lever is mounted pivotally on a shaft 56 journaled in a pair of laterally spaced support plates 58 and 60 secured to the opposite ends of the handle.

Figure 5:
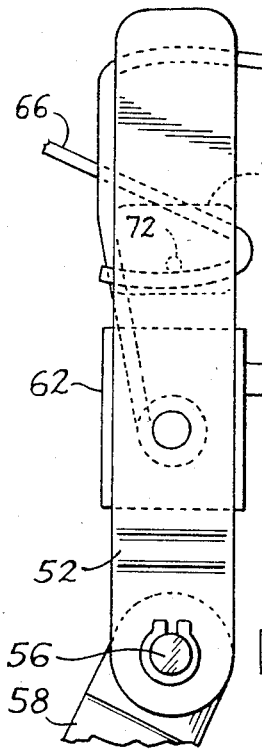
FIGS. 5 and 6 are fragmentary side and rear views, respectively, of one embodiment of the levers incorporating winches for adjustment of the bowstring end segments and draw length of bow.
Figure 6:
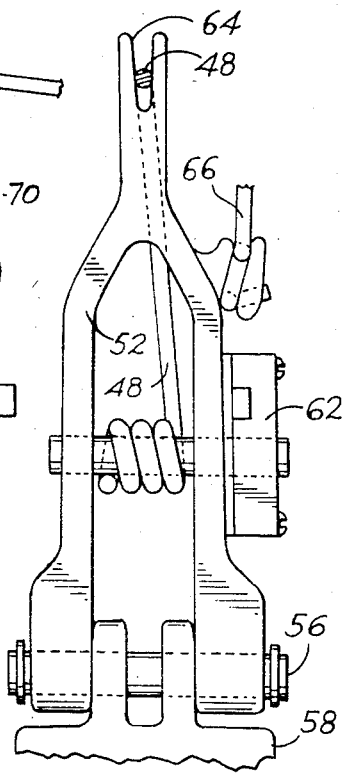
Figure 7:
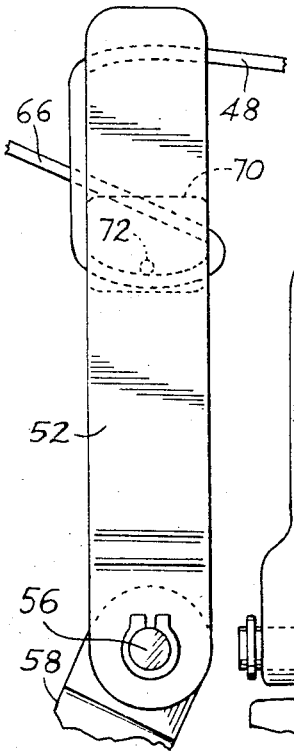
FIGS. 7 and 8 are fragmentary side and rear views, respectively, of another embodiment of the levers without the adjustment winches.
Figure 8:
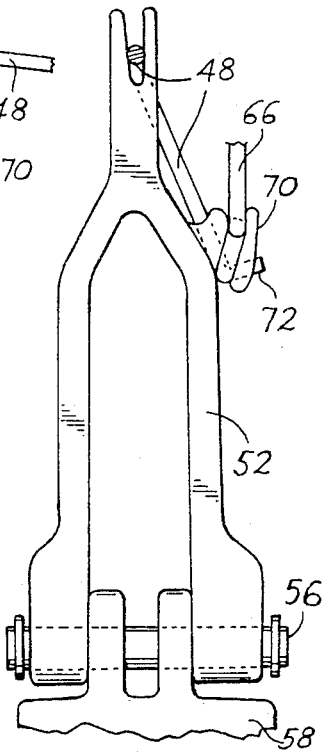

In the embodiment illustrated, provision for adjusting the tension of the terminal end portions 48 and 50 is made by use of ratchet type winches 62, one incorporated on each lever, as best illustrated in FIGS. 5 and 6. The winch is described in detail in my U.S. Pat. No. 4,057,220. It will be understood that although use of the winch is preferred, it may be omitted, as shown in FIGS. 7 and 8. In such event, adjustment of the terminal end portions is provided through adjustment of the limbs by the screws 20, as previously described.

The outer end of each lever is provided with a slot 64 or other suitable means, by which to guide the terminal end portion of the bowstring extending from the associated cam member, to the winch where it is secured. The terminal end portion thus operatively connects the lever with the associated limb such that operation of the winch to take in or pay out the line functions to increase or decrease the tension and curvature of the limb, thereby varying the tension exerted on the working stretch of the bowstring.

One end of each of a pair of elongated, flexible control lines 66 and 68 is formed into a closed loop about each cam pivot shaft 36. The lines extend inwardly therfrom and each is trained about an anchor post 70 incorporated on the opposite lever. Set screws 72 secure the control lines to each post. Since the control lines connect the limbs to the opposite levers, the anchor posts project laterally outward from the levers to provide clearance for an arrow travelling along a straight line between the nocking point 24 of the bowstring and an arrow rest (not shown) on the handle member.

Adjustment of each winch 62 serves to adjust draw length and the tension of the control line associated with the oppsoite limb. The connection of the cam members 32 and 34 to the opposite limbs 12 and 14, respectively, through the terminal end portions 48 and 50, levers 52 and 54, and control lines 66 and 68, provides still another important function; namely, the maintenance of limb balance throughout the draw and release of the bowstring. To illustrate, let it be assumed that the upper limb 12, (FIG. 1) is weaker than the lower limb 14. Thus, during the draw, the upper limb tends to bend more than the lower limb, with consequent greater clockwise rotation of cam 32 than counterclock wise rotation of cam 34.

The greater rotation of cam 32 produces an upward pivotal movement of lever 52. Accordingly, the greater movement of the lever increases the tension exerted on the control line 68 associated with the opposite limb 14. This equalizes the flexure of the limbs and the rotation of the cams throughout the draw and release of the bowstring. This is reflected in the movement of the nocking point 24, and hence the arrow, along a straight line extending through the arrow rest.

The cam structure described hereinbefore is intended for use primarily with compound archery bows of light to moderate bow string pull weight. It has been observed that while the cam performs very well in the range intended, over extended usuage in that range and over a shorter time of usage with heavy bow string pull weights, it results in breakage ofthe lines 26, 48 or 28, 50 in the areas of the radial bores 42 and 44. The constructions of the embodiments of FIGS. 9–11 and 12, utilize the basic principle of the cam 32 and afford extended usage in all pull weight applications.

Figure 10:
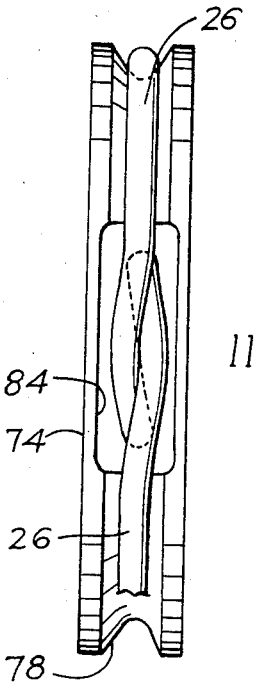
FIG. 10 is a end view of the cam member as seen from the left in FIG. 9.
Figure 9:
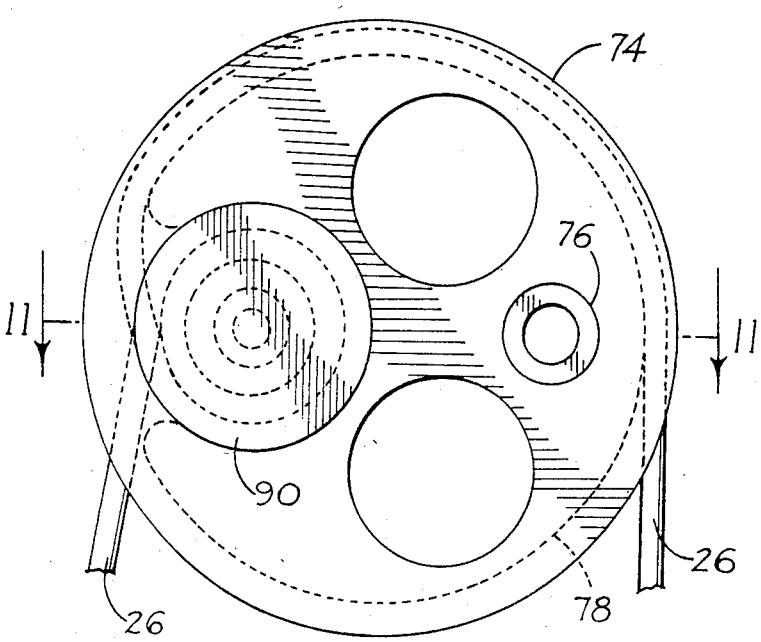
FIG. 9 is a fragmentary side elevation of a second embodiment of the cam member of this invention.
Figure 11:
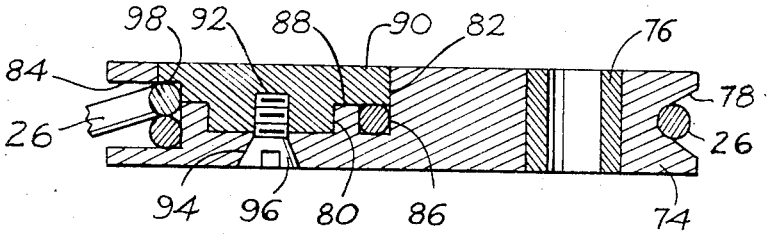
FIG. 11 is a sectional view of the cam member taken along the line 11—11 in FIG. 9.

Referring first to FIGS. 9–11, the eccentric cam member 74 is arranged for mounting to each of the bow limbs 12 and 14 by means of a pivot shaft 36 extended through eccentrically located pivot bearing 76. The cam member includes a single circumferential bow string guide groove 78 similar to groove 40 of the cams 32 and 34 previously described.

As best shown in FIGS. 9 and 11, this embodiment replaces the radial bores 42 and 44 of each of the previously described cams 32 and 34 with means for securing the bow string and members 26 and 28 to the interior of the cam in a smooth crossing loop. To this end a circular opening 80 is bored into one side surface of each cam inwardly of the outer periphery. A larger diameter countersunk circular opening 82 extends from the opening 80 to the side surface of the cam and communicates with peripheral groove 78 through widened opening 84.

There is also provided an annular bow string anchor groove 86 spaced concentrically around the bore opening 80 and separated therefrom by an annular ring 88. The upper side of groove 86 is exposed to the opening 82. The groove 86 and ring 88 are configured to be slightly less in depth than the diameter of the bow string end number 26 or 28 so that, when disposed in the groove the upper side surface of the end member projects slightly into the bore opening 82.

The end segment 26 is installed in the cam member 74 by forming a crossed loop and inserting it inwardly through the widened opening 84 between the anchor groove 86.

As best illustrated in FIGS. 9 and 10, the bow string end segment 26 is trained counterclockwise about the bow string guide groove 78, then into the lower portion of groove 86 and counterclockwise around it and back onto the groove 78. It is to be noted that the end segment 26 is crossed in the enlarged opening 84 substantially in the central plane of the peripheral groove 78.

Means for releasably securing the loop portion of end segment 26 in the groove 86 is provided by a plug 90 configured to be received within the openings 80 and 82. The plug incorporates a centrally located threaded bore 92 arranged for alignment with a countersunk bore 94 in the cam member, concentric with opening 80, for the reception of an anchor screw 96. An inner segment 98 of the plug is cut away to register with and complete the profile of the enlarged opening 84 in the cam member.

As previously discussed, one side surface of the bow string end segment 26 arranged in the groove 86 extends slightly into the opening 82. Accordingly, insertion of the plug 90 into the space provided by the openings 80 and 82 and tightening of anchor screw 96 in threaded bore 92 in the plug, draws the plug securely into the spaced provided by the openings. In this manner the plug serves to overlie and securely press against the loop portion of the bow string end segment in the groove 86 and thus clamp the bow string against movement in the groove.

Figure 12:
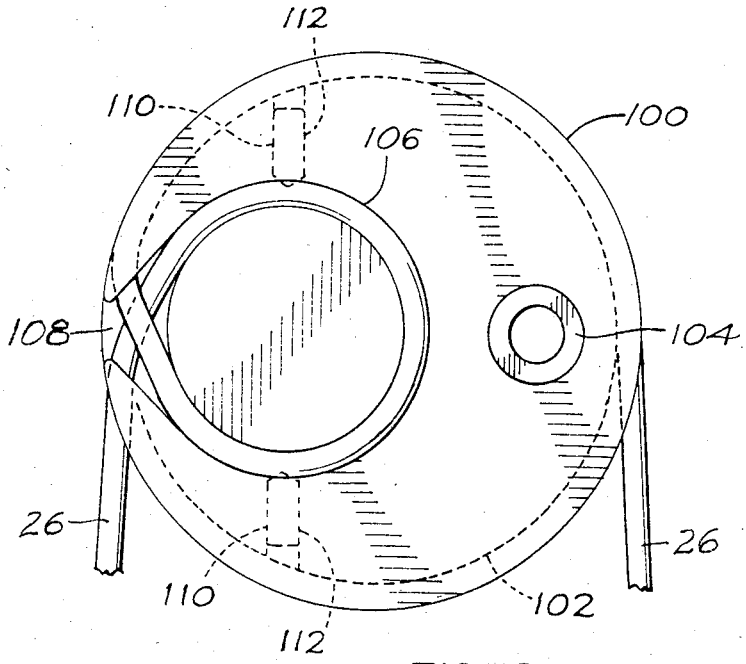
FIG. 12 is a fragmentary side elevation of another embodiment of the cam member of this invention.

The embodiment of FIG. 12 is similar in principle to the embodiment of FIGS. 9–11, but it incorporates a different structure for the bow string securing means. In FIG. 12 the cam 100 incorporates bow string guide groove 102 and eccentric mounting shaft bearing 104, similar to the groove 78 and shaft bearing 76 of cam 74. Circular bow string anchor groove 106 communicates with guide groove 102 through a slot 108 which extends between them. Threaded bores 110 are provided in the cam to intercept the anchor groove 106 and to mount threaded set screws 112.

The bow string end segment 26 is trained counterclockwise about the circumferential guide groove 102, and then counterclockwise about the bow string anchor groove 106 and thence back onto the guide groove again. The set screws 112 are then turned to firmly contact the loop portion of the bow string end segment and secure the same in the anchor groove.

The embodiments of FIGS. 9–12 offer the advantage of increasing the draw length by at least one inch over the cam member of FIG. 3. The embodiment of FIGS. 9–11 is easier and quicker to manufacture, and therefore less costly, than the embodiments of FIGS. 3 and 12. It also avoids the disadvantage of the set screws 46 and 112 which tend to flatten the end segments 26 and 28 render difficult any readjustment or re-use of the end segments.

In the operation of the archery bow illustrated, as the working stretch 22 of the bowstring is drawn back from the rest position to the position of full draw shown in FIG. 2, the eccentric cam member 32 at the top of the bow is caused to rotate clockwise about the axis of its pivot shaft 36 and the cam member 34 at the bottom of the bow is caused to rotate counterclockwise about the axis of its pivot shaft. The eccentric rotation of the cam members operate to produce a varying pull weight which is characterized by the curve illustrated in FIG. 10 of my U.S. Pat. No. 3,841,295.

Thus, as the bowstring is drawn, the terminal end portions 48 and 50 are drawn around the cam members 32 and 34, thereby pulling the levers 52 and 54 toward their associated limbs. The tension thus produced by the con-. trol lines 66 and 68 on the opposite limbs maintains the balance of the limbs and cam members.

From the foregoing it will be appreciated that the present invention provides a compound bow construction which provides all of the beneficial characteristics of the compound bow of my U.S. Pat. No. 3,841,295 while materially reducing the manufacturing cost of the bow. Further, this improved construction affords increased speed of arrow flight and corresponding greater shooting accuracy It will also be seen that in utilizing the center-pull cam construction with a single circumferential groove, each bow string end segment 26 and 28 is guided in its associated single groove 40, 78 or 102 during rotation of the cam between the rest position of FIG. 1 and the full draw position of FIG. 2 and extends from the opposite, substantially diametrical sides of its single groove both to the bow string 22 and to the attachment to the bow. Accordingly, there is no lateral transfer of weight and pull of the string from one groove to another as the bowstring is drawn and released, as with conventional two-groove cams. Accordingly, no oscillation of the arrow is caused because there is no rapid lateral shifting of the bowstring from one side of the cam to the other. This results in reduced air friction and correspondingly increased speed, stability and distance of arrow flight.

It will be apparent to those skilled in the art that various changes may be made in the size, shape, type, number and arrangement of parts described hereinbefore. For example, the end segments 26 and 28 may be integral extensions of the bowstring 22, although the separable extension arrangement illustrated is preferred. The bowstring terminal end portions 48 and 50 are to be considered bowstring terminal end members which are integral extensions of the bowstring or are separate extensions thereof. These and other changes may be made without departing from the spirit of this invention and the scope of the appended claims.

Having now described my invention and the manner in which it may be used, I claim:

1. In combination with a compound archery bow wherein a pair of rotary cam members is mounted eccentrically one on the outer end of each bow limb and a bow string extends between the cam members and opposite end segments thereof are secured to the cam members and extending therefrom to attachment to the bow at positions independent of the rotation of the cam members, the pair of rotary cam members each comprising:

(a) a disc having only one circumferential guide grove, the bow string end segment extending outwardly from the associated end of the bow string into contact with the rearward side of the disc groove, thence forwardly around the disc groove for anchoring adjacent the forward side of the disc groove in the rest position of the bow string and thence inwardly out of engagement with the forward side of the disc groove to attachment to the bow at a position independent of the rotation of the other cam member, and (b) securing means on the disc for releasably securing thereto a portion of the single wrap of bow string end segment adjacent the forward side of the disc groove in the rest position of the bow string, the bow string end segment extending in opposite directions from the securing means being receivable in the single circumferential guide groove in an unlapped single wrap throughout the range of rotation of the disc between rest and full draw positions of the bow string.

2. In combination with a compound archery bow wherein a pair of rotary cam members is mounted eccentrically one on the outer end of each bow limb and a bow string extends between the cam members and opposite end segments thereof are secured to the cam members and extending therefrom to attachment to the bow at positions independent of the rotation of the cam members, the pair of rotary cam members each comprising:

(a) a disc having only one circumferential guide groove, the bow string end segment extending outwardly from the associated end of the bow string into contact with the rearward side of the disc groove, thence forwardly around the disc groove for anchoring adjacent the forward side of the disc groove in the rest position of the bow string and thence inwardly out of engagement with the forward side of the disc groove to attachment to the bow at a position independent of the rotation of the other cam member, and (b) securing means on the disc for releasably securing thereto a portion of the single wrap of bow string end segment adjacent the forward side of the disc groove in the rest position of the bow string, the securing means on the disc comprising a substantially circular bow string anchor groove positioned radially inward of and substantially in the plane of the circumferential groove and communicating therewith through a widened opening that is wide enough to contain a crossed portion of bow string end segment, the end segment extending in a portion of the circumferential groove in a given direction, thence through said widened opening and around the anchor groove in the same said given direction, thence outward through said widened opening wherein the bow string end segment portions cross, and thence in a portion of the circumferential groove in the same said given direction, and bow string anchor means mounted on the cam member for movement toward and away from said anchor groove for releasably securing the end segment in said anchor groove, the bow string end segment extending in opposite directions from the securing means being receivable in the single circumferential guide groove in an unlapped single wrap throughout the range of rotation of the disc between rest and full draw positions of the bow string.

3. The combination of claim 2 wherein the depth of the anchor groove in the axial direction of the disc is less than the thickness of the bow string end segment and said bow string anchor means comprises a plug configured to contact the surface of the bow string end segment loop projecting from the depth of said anchor groove, the plug being arranged to be tightened toward the anchor groove into releasable clamping engagement with said bow string end segment loop in the anchor groove.

4. The combination of claim 2 wherein said bow string anchor means comprises at least one set screw in the disc arranged to retractably intercept the bow string anchor groove to releasably clamp the bow string end segment in the anchor groove.

* * * * *

US004593674B1

REEXAMINATION CERTIFICATE (2054th)

United States Patent [19]

Kudlacek

[11] B1 4,593,674

[45] Certificate Issued Jul. 6, 1993

[54] COMPOUND ARCHERY BOW

[76] Inventor: Donald S. Kudlacek, 4312 Oak St., Longview, Wash. 98632

Reexamination Request:
No. 90/002,529, Nov. 29, 1991

Reexamination Certificate for:

| | |
|---|---|
| Patent No.: | **4,593,674** |
| Issued: | **Jun. 10, 1986** |
| Appl. No.: | **647,117** |
| Filed: | **Sep. 4, 1984** |

Related U.S. Application Data

[63] Continuation of Ser. No. 315,704, Oct. 28, 1981, abandoned, which is a continuation-in-part of Ser. No. 194,429, Oct. 6, 1980, abandoned.

[51] Int. Cl.[5] ..... F41B 5/10

[52] U.S. Cl. ..... 124/25.6; 124/86; 124/900

[58] Field of Search ..... 124/23.1, 24.1, 25.6, 124/86, 88, 900

[56] References Cited

U.S. PATENT DOCUMENTS 138,051 4/1873 Shaw .
3,993,039 11/1976 Groves et al. .
4,187,826 2/1980 Killian .
4,202,316 5/1980 Barna .
4,353,346 10/1982 Barna .
4,401,097 8/1983 Simonds et al. ..... 124/25.6

*Primary Examiner*—Randolph A. Reese

[57] ABSTRACT

A compound archery bow of simplified construction includes a bowstring secured intermediate its ends to eccentrically pivoted cams mounted at the outer ends of the limbs secured to the opposite ends of a handle member. A control cable connects each cam pivot shaft, and therefore each limb, to a laterally projecting post on a lever mounted pivotally on the end of the handle member that secures the opposite limb. The end segments of the bowstring are trained around the cams and through the diametric center of each cam wherein the segments are secured. Each terminal end portion of the bowstring end segments is secured either to a winch located on the lever mounting the associated cam, or directly to said lever. The connection of the limbs to each other through the control cables and the bowstring end segments secured to the levers balance the flexure of the limbs relative to each other as well as the rotation of each cam as the bowstring is drawn back. Adjustment of the length of the bowstring terminal end portions effects adjustment of the tension and flexure of the limbs, pull weight of the bowstring and angular disposition of the cams.

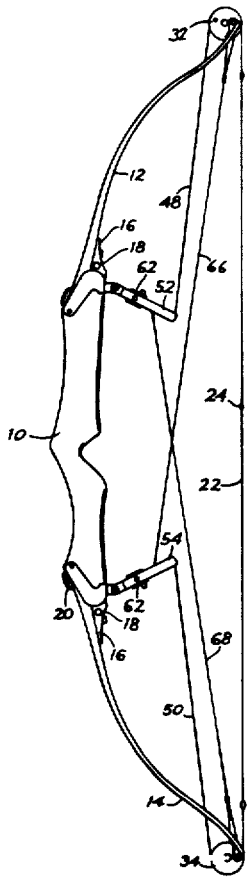

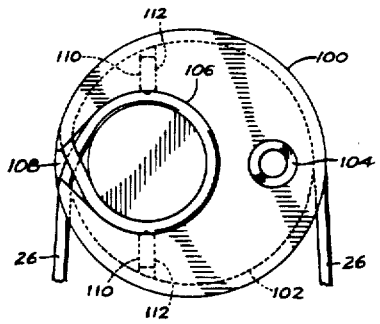

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 16–22:

Archery bows of the class described, and commonly referred to as compound bows have been provided heretofore. Their principal advantage resides in the reduction of pull weight at full draw, whereby an archer may utilize a pull weight greater than [this] *his* normal physical capabilities, simultaneously affording greater sighting control.

Column 2, lines 28–43:

For this purpose, means for adjusting the limbs angularly relative to the handle member is provided by interengaging bearing means embodied herein as flanges 16 which receive cooperating pivot shafts 18. The flanges are mounted on the inner end portions of the limbs [adjaceht] *adjacent* the ends of the handle member 10. A pivot shaft 18 cooperating with each flange is provided through the handle member, pivotally connecting each limb to opposite ends of the handle. Limb adjusting screws 20 are threaded *through* the terminal end portion of each limb and into the handle member. Rotating the limb screws 20 to move them inwardly or outwardly relative to the handle causes the corresponding limb to pivot about the bearing shaft. Accordingly, the angle of each limb relative to the handle may be adjusted independently.

Column 3, lines 9–25:

The terminal end portions 48 to 50 of the end segments 26 and 28 extend from the set screws 46 through the radial bores and are trained back onto the guide grooves 40 of the cam members. Although shown as a [continous] *continuous* line extending through the pairs of radial bores, the bowstring end segments and terminal end portions are effectively divided into two parts by being secured by set screw 46. Accordingly, it will be understood that securing the ends of two separate lines in the radial bores, as by separate set screws or other connectors, would accomplish the same result. Therefore, the portions 48 and 50 of the end segments 26 and 28 extending beyond the set screws 46 are identified herein as terminal end portions 48 and 50 of the end segments 26 and 28 of the bowstring, and may be provided as separate lines.

Column 4, lines 24–60:

The cam structure described hereinbefore is intended for use primarily with compound archery bows of light to moderate [bow string] *bowstring* pull weight. It has been observed that while the cam performs very well in the range intended, over extended [usage] *usage* in that range and over a shorter time of usage with heavy

[bow string] *bowstring* pull weights, it results in breakage [ofthe] *of the* lines 26, 48 or 28, 50 in the areas of the radial bores 42 and 44. The constructions of the embodiments of FIGS. 9–11 and 12, utilize the basic principle of the cam 32 and afford extended usage in all pull weight applications.

Referring first to FIGS. 9–11, the eccentric cam member 74 is arranged for mounting to each of the bow limbs 12 and 14 by means of a pivot shaft 36 extended through eccentrically located pivot bearing 76. The cam member includes a single circumferential [bow string] *bowstring* guide groove 78 similar to groove 40 of the cams 32 and 34 previously described.

As best shown in FIGS. 9 and 11, this embodiment replaces the radial bores 42 and 44 of each of the previously described cams 32 and 34 with means for securing the [bow string and members] *bowstring end segments* 26 and 28 to the interior of the cam in a smooth crossing loop. To this end a circular opening 80 is bored into one side surface of each cam inwardly of the outer periphery. A larger diameter countersunk circular opening 82 extends from the opening 80 to the side surface of the cam and communicates with peripheral groove 78 through widened opening 84.

There is also provided an annular [bow string] *bowstring* anchor groove 86 spaced concentrically around the bore opening 80 and separated therefrom by an annular ring 88. The upper side of groove 86 is exposed to the opening 82. The groove 86 and ring 88 are configured to be slightly less in depth than the diameter of the [bow string] *bowstring* end [number] *segments* 26 or 28 so that, when disposed in the groove the upper side surface of the end [member] *segment* projects slightly into the bore opening 82.

Column 4, lines 65–68 to Column 5, lines 1–3:

As best illustrated in FIGS. 9 and 10, the [bow string] *bowstring* end segment 26 is trained counterclockwise about the [bow string] *bowstring* guide groove 78, then into the lower portion of groove 86 and counterclockwise around it and back onto the groove 78. It is to be noted that the end segment 26 is crossed in the enlarged opening 84 substantially in the central plane of the peripheral groove 78.

Column 5, lines 14–51:

As previously discussed, one side surface of the [bow string] *bowstring* end segment 26 arranged in the groove 86 extends slightly into the opening 82. Accordingly, insertion of the plug 90 into the space provided by the openings 80 and 82 and tightening of anchor screw 96 in threaded bore 92 in the plug, draws the plug securely into the [spaced] *space* provided by the openings. In this manner the plug serves to overlie and securely press against the loop portion of the [bow string] *bowstring* end segment in the groove 86 and thus clamp the [bow string] *bowstring* against movement in the groove.

The embodiment of FIG. 12 is similar in principle to the embodiment of FIGS. 9–11, but it incorporates a different structure for the bow [bow string] *bowstring* securing means. In FIG. 12 the cam 100 incorporates [bow string] *bowstring* guide groove 102 and eccentric mounting shaft bearing 104, similar to the groove 78 and shaft bearing 76 of cam 74. Circular [bow string] *bowstring* anchor groove 106 communicates with guide groove 102 through a slot 108 which extends between them. Threaded bores 110 are provided in the cam to [intercept] *intersect* the anchor groove 106 and to mount threaded set screws 112.

The [bow string] *bowstring* end segment 26 is trained counterclockwise about the circumferential guide groove 102, and then counterclockwise about the [bow string] *bowstring* anchor groove 106 and thence back onto the guide groove again. The set screws 112 are then turned to firmly contact the loop portion of the [bow string] *bowstring* end segment and secure the same in the anchor groove.

The embodiments of FIGS. 9–12 offer the advantage of increasing the draw length by at least one inch over the cam member of FIG. 3. The embodiment of FIGS. 9–11 is easier and quicker to manufacture, and therefore less costly, than the embodiments of FIGS. 3 and 12. It also avoids the disadvantage of the set screws 46 and 112 which tend to flatten the end segments 26 and 28 *and* render difficult any readjustment or reuse of the end segments.

Column 5, lines 63–68:

Thus, as the bowstring is drawn, the terminal end portions 48 and 50 are drawn around the cam members 32 and 34, thereby pulling the levers 52 and 54 toward their associated limbs. The tension thus produced by the [con-.trol] *control* lines 66 and 68 on the opposite limbs maintains the balance of the limbs and cam members.

Column 6, lines 1–24:

From the foregoing it will be appreciated that the present invention provides a compound bow construction which provides all of the beneficial characteristics of the compound bow of my U.S. Pat. No. 3,841,295 while materially reducing the manufacturing cost of the bow. Further, this improved construction affords increased speed of arrow flight and corresponding greater shooting accuracy. It will also be seen that in utilizing the center-pull cam construction with a single circumferential groove, each [bow string] *bowstring* end segment 26 and 28 is guided in its associated single groove 40, 78 or 102 during rotation of the cam between the rest position of FIG. 1 and the full draw position of FIG. 2 and extends from the opposite, substantially diametrical sides of its single groove both to the [bow string] *bowstring* 22 and to the attachment to the bow. Accordingly, there is no lateral transfer of weight and pull of the string from one groove to another as the bowstring is drawn and released, as with conventional two-groove cams. Accordingly, no oscillation of the arrow is caused because there is no rapid lateral shifting of the bowstring from one side of the cam to the other. This results in reduced air friction and correspondingly increased speed, stability and distance of arrow flight.

The drawing figures have been changed as follows: In FIGS. 5 through 8, reference numeral 66 has been changed to 68.

AS A RESULT OF REEXAMINATION, IT HAS BEEN DETERMINED THAT:

Claims 1–3 and 4 are determined to be patentable as amended.

New claims 5–8 are added and determined to be patentable.

1. In combination with a compound archery bow wherein a pair of rotary cam members is mounted eccentrically one on the outer end of each bow limb and a [bow string] *bowstring* extends between the cam members and opposite end segments thereof are secured to the cam members and [extending] *extend* therefrom to attachment to the bow at positions independent of the rotation of the cam members, the pair of rotary cam members each comprising:

(a) a disc having only one circumferential guide [grove] *groove*, the [bow string] *bowstring* end segment extending outwardly from the associated end of the [bow string] *bowstring* into contact with the rearward side of the disc groove, thence forwardly around the disc groove for anchoring adjacent the forward side of the disc groove in the rest position of the [bow string] *bowstring* and thence inwardly out of engagement with the forward side of the disc groove to attachment to the bow at a position independent of the rotation of the other cam member, and (b) securing means on the disc for releasably *and fixedly* securing [thereto] a portion of the single wrap of [bow string] *bowstring* end segment *in an attachment to the disc groove at a fixed location thereon* adjacent the forward side of the disc groove in the rest postion of the [bow string] *bowstring, and for maintaining said attachment at said fixed location irrespective of the extent to which the bowstring is drawn,* the [bow string] *bowstring* end segment extending in opposite directions from the securing means being receivable in the single circumferential guide groove in an unlapped single wrap throughout the range of rotation of the disc between rest and full draw positions of the [bow string] *bowstring*.

2. In combination with a compound archery bow wherein a pair of rotary cam members is mounted eccentrically one on the outer end of each bow limb and a [bow string] *bowstring* extends between the cam members and opposite end segments thereof are secured to the cam members and [extending] *extend* therefrom to attachment to the bow at positions independent of the rotation of the cam members, the pair of rotary cam members each comprising:

(a) a disc having only one circumferential guide groove, the [bow string] *bowstring* end segment extending outwardly from the associated end of the [bow string] *bowstring* into contact with the rearward side of the disc groove, thence forwardly around the disc groove for anchoring adjacent the forward side of the discgroove in the rest position of the [bow string] *bowstring* and thence inwardly out of engagement with the forward side of the disc groove to attachment to the bow at a position independent of the rotation of the other cam member, and (b) securing means on the disc for releasably *and fixedly* securing [thereto] a portion of the single wrap of [bow string] *bowstring* end segment *to the disc at a fixed point irrespective of disc rotation and* adjacent the forward side of the disc groove in the rest position of the [bow string] *bowstring*, the securing means on the disc comprising a substantially circular [bow string] *bowstring* anchor groove positioned radially inward of and substantially in the plane of the circumferential groove and communicating therewith through a widened opening that is wide enough to contain a crossed portion of [bow string] *bowstring* end segment, the end segment extending in a portion of the circumferential groove in a given direction, thence through said widened opening and around the anchor groove in the same said given direction, thence outward through said widened opening wherein the [bow string] *bowstring* end segment portions cross, and thence in a portion of the circumferential groove in the same said given direction, and [bow string] *bowstring* anchor means mounted on the cam member for movement toward and away from said anchor groove for releasably securing the end segment in said anchor groove, the [bow string] *bowstring* end segment extending in opposite directions from the securing means being receivable in the single circumferential guide groove in an unlapped single wrap throughout the range of rotation of the disc between rest and full draw positions of the [bow string] *bowstring*.

3. The combination of claim 2 wherein the depth of the anchor groove in the axial direction of the disc is less than the thickness of the [bow string] *bowstring* end segment and said [bow string] *bowstring* anchor means comprises a plug configured to contact the surface of the [bow string] *bowstring* end segment loop projecting from the depth of said anchor groove,the plug being arranged to be tightened toward the anchor groove into releasable clamping engagement with said [bow string] *bowstring* end segment loop in the anchor groove.

4. The combination of claim 2 wherein said [bow string] *bowstring* anchor means comprises at least one set screw in the disc arranged to retractably intercept the [bow string] *bowstring* anchor groove to releasably clamp the [bow string] *bowstring* end segment in the anchor groove.

*5. The combination of claim 1 wherein each disc is circular.*

*6. The combination of claim 2 wherein each disc is circular.*

*7. In combination with a compound archery bow wherein a pair of rotary cam members is mounted eccentrically one on the outer end of each bow limb and a bowstring extends between the cam members and opposite end segments thereof are secured to the cam members and extend therefrom to attachment to the bow at positions independent of the rotation of the cam members, the pair of rotary cam members each comprising:*

*(a) a disc having only one circumferential guide groove, the bowstring end segment extending outwardly from the associated end of the bowstring into contact with the rearward side of the disc groove, thence forwardly around the disc groove for anchoring adjacent the forward side of the disc groove in the rest position of the bowstring and thence inwardly out of engagement with the forward side of the disc groove to attachmentto the bow at a position independent of the rotation of the other cam member, and*

*(b) securing means on the disc for releasably securing thereto a portion of the single wrap of bowstring end segment adjacent the forward side of the disc groove in the rest position of the bowstring, the bowstring end segment extending in opposite directions from the securing means being receivable in the single circumferential guide groove in an unlapped single wrap throughout the range of rotation of the disc between rest and full draw positions of the bowstring, said securing means including means fixing said bowstring end segment to said disc for preventing said disc from being rotated beyond a predetermined range of rotation during the drawing of the bowstring.*

*8. The combination of claim 7 wherein each disc is circular.*

* * * * *